United States Patent [19]

Rowley et al.

[11] 3,991,599

[45] Nov. 16, 1976

[54] RIB FORMING TOOL FOR TUBING

[75] Inventors: James P. Rowley, Downers Grove; Edward F. Lewandowski, Westmont; Edward F. Groh, Naperville, all of Ill.

[73] Assignee: The United States of America as represented by the United States Energy Research and Development Administration, Washington, D.C.

[22] Filed: Dec. 2, 1975

[21] Appl. No.: 636,883

[52] U.S. Cl. ..... 72/121; 72/124; 72/211; 72/215

[51] Int. Cl.[2] ..... B21D 3/02; B21D 17/04

[58] Field of Search ..... 72/121, 123, 124, 211, 72/215, 216, 110, 703

[56] References Cited

UNITED STATES PATENTS

| | | | |
|---|---|---|---|
| 1,112,662 | 10/1914 | Schley | 72/703 |
| 2,235,616 | 3/1941 | Ice | 72/211 |
| 2,645,953 | 7/1953 | Schlitters | 72/703 |
| 3,867,824 | 2/1975 | Takagi et al. | 72/121 |

*Primary Examiner*—Leonidas Vlachos

*Attorney, Agent, or Firm*—Dean E. Carlson; Arthur A. Churm; Joseph N. Hosteny

[57] ABSTRACT

Three cylindrical rollers are rotatably mounted equidistant from the center of a hollow tool head on radii spaced 120° apart. Each roller has a thin flange; the three flanges lie in a single plane to form an internal circumferential rib in a rotating tubular workpiece. The tool head has two complementary parts with two rollers in one part of the head and one roller in the other part; the two parts are joined by a hinge. A second hinge, located so the rollers are between the two hinges, connects one of the parts to a tool bar mounted in a lathe tool holder. The axes of rotation of both hinges and all three rollers are parallel. A hole exposing equal portions of the three roller flanges is located in the center of the tool head. The two hinges permit the tool head to be opened and rotated slightly downward, taking the roller flanges out of the path of the workpiece which is supported on both ends and rotated by the lathe. The parts of the tool head are then closed on the workpiece so that the flanges are applied to the workpiece and form the rib. The tool is then relocated for forming of the next rib.

2 Claims, 4 Drawing Figures

Fig-3
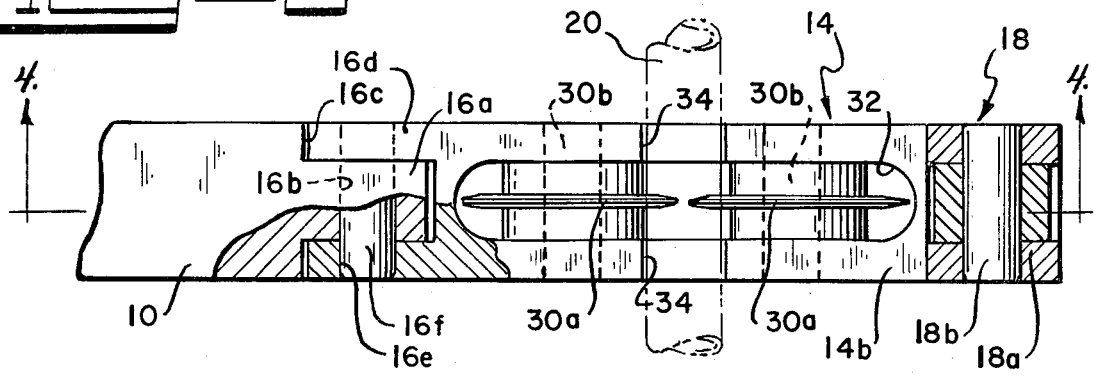
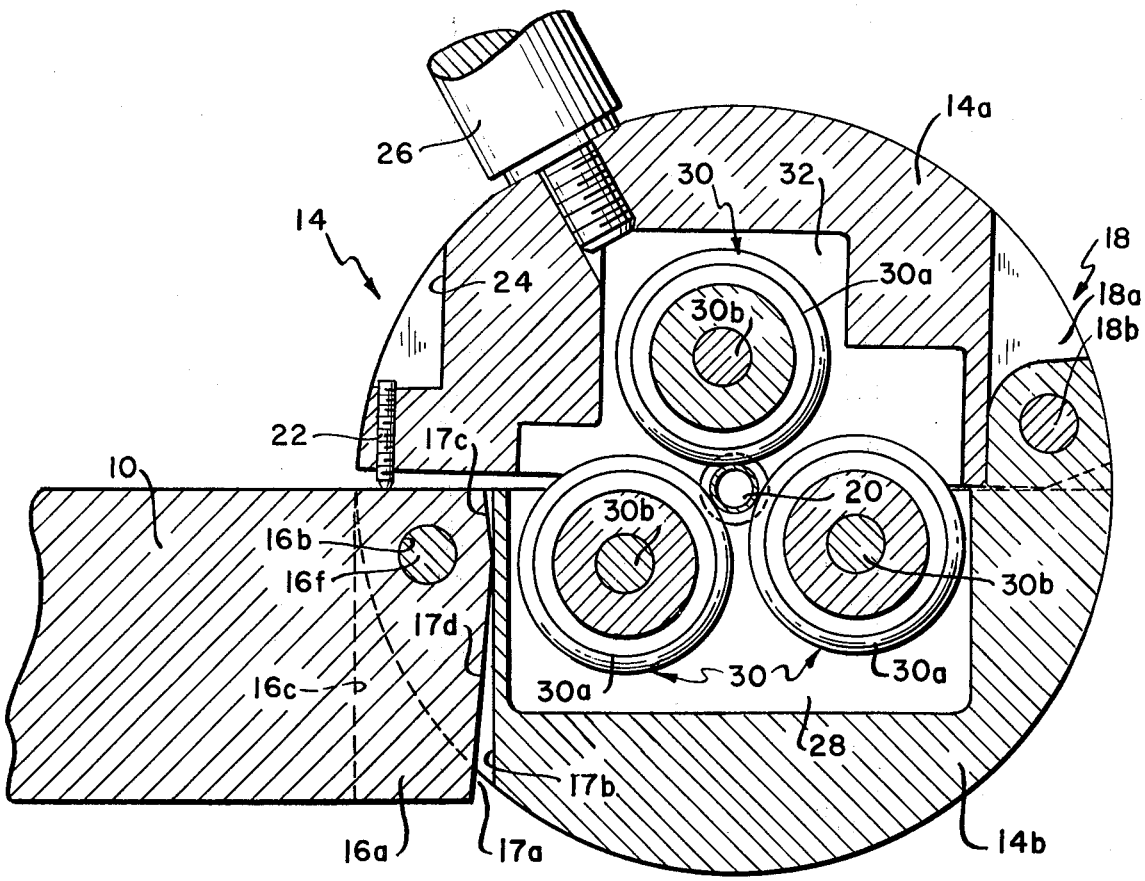
Fig-4

RIB FORMING TOOL FOR TUBING

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

The invention relates to a tool which may be employed in a lathe to make internal circumferential ribs in small diameter, thin-walled tubing.

Previous methods of forming circumferential ribs in tubing include three-roll forming, explosive or electrohydraulic forming, electromagnetic forming, hydraulic forming, press methods and rotary swaging. (See the *Metals Handbook*, Volume 4, *Forming*, 8th Edition, 1969, American Society for Metals, Metals Park, Ohio.) However, all of these methods entail disadvantages not incurred by the present invention. For example, three-roll forming requires starting the process with a plate and is generally limited to tube diameters larger than that encompassed by the present invention. Also, rotary swaging is generally limited to tubes with a final wall thickness of 0.025 inch or greater; the present invention provides for wall thicknesses at least as small as 0.015 inch. All of these methods except three-roll forming require the preparation of dies or mandrels or both for making ribs. The use of a die or mandrel, of course, means that for each variation or rib depth, number of ribs per unit length of tubing or different size tubings a new die or mandrel must be prepared. The present invention operated entirely without the use of dies or mandrels; only a low melting point plastic tooling compound is used to give some additional support to the tube and maintain its diameter. Furthermore, the present invention operates without lubricants on the workpiece. Additionally, hydraulic forming is limited mostly to more ductile materials, such as copper, than are encompassed by the present invention. Finally, electromagnetic forming would require the use of a driver due to the relatively low conductance of stainless steel as compared to aluminum, copper, etc. The ability of the present invention to function without the use of dies or mandrels also means that the expense for small lots of identical tubes will be decreased in comparison to methods utilized by the prior art.

SUMMARY OF THE INVENTION

According to the present invention, three rollers are mounted rotatably within a hollow tool head. The rollers are mounted equidistant from the center of the tool head on radii spaced 120° apart. Each roller has a thin circumferential tapered flange; the three flanges lie in a single plane perpendicular to the longitudinal axis of a tubular workpiece. The tool head has two complementary parts so that a tube may be passed through a hole in the center of the tool head between two rollers mounted in one part of the tool head and a single roller mounted in the other part. The three roller flanges equally overlap the center hole in the tool head. The part of the tool head with two rollers is hinged to a tool bar and the part of the tool head with one roller is hinged to the other part. The degree of separation between the parts in the closed position of the tool head is determined by a screw having threaded engagement with one part and projecting into into contact with the tool bar.

An object of the invention is to provide a tool for forming uniform internal circumferential ribs in thin-walled tubing.

It is a further object of the invention to provide a tool for forming internal ribs with a range of different depth or pitch dimensions in tubing of different outside diameters or wall thicknesses without dies, mandrels or the use of lubricants and while maintaining the circularity of the tubing within desired limits.

BRIEF DESCRIPTION OF THE DRAWINGS

FIG. 3 is a section taken on line 3—3 of FIG. 2.

FIG. 4 is a section of the rib forming tool taken on line 4—4 in FIG. 3.

SPECIFIC EMBODIMENT OF THE INVENTION

Figures 1, 2:
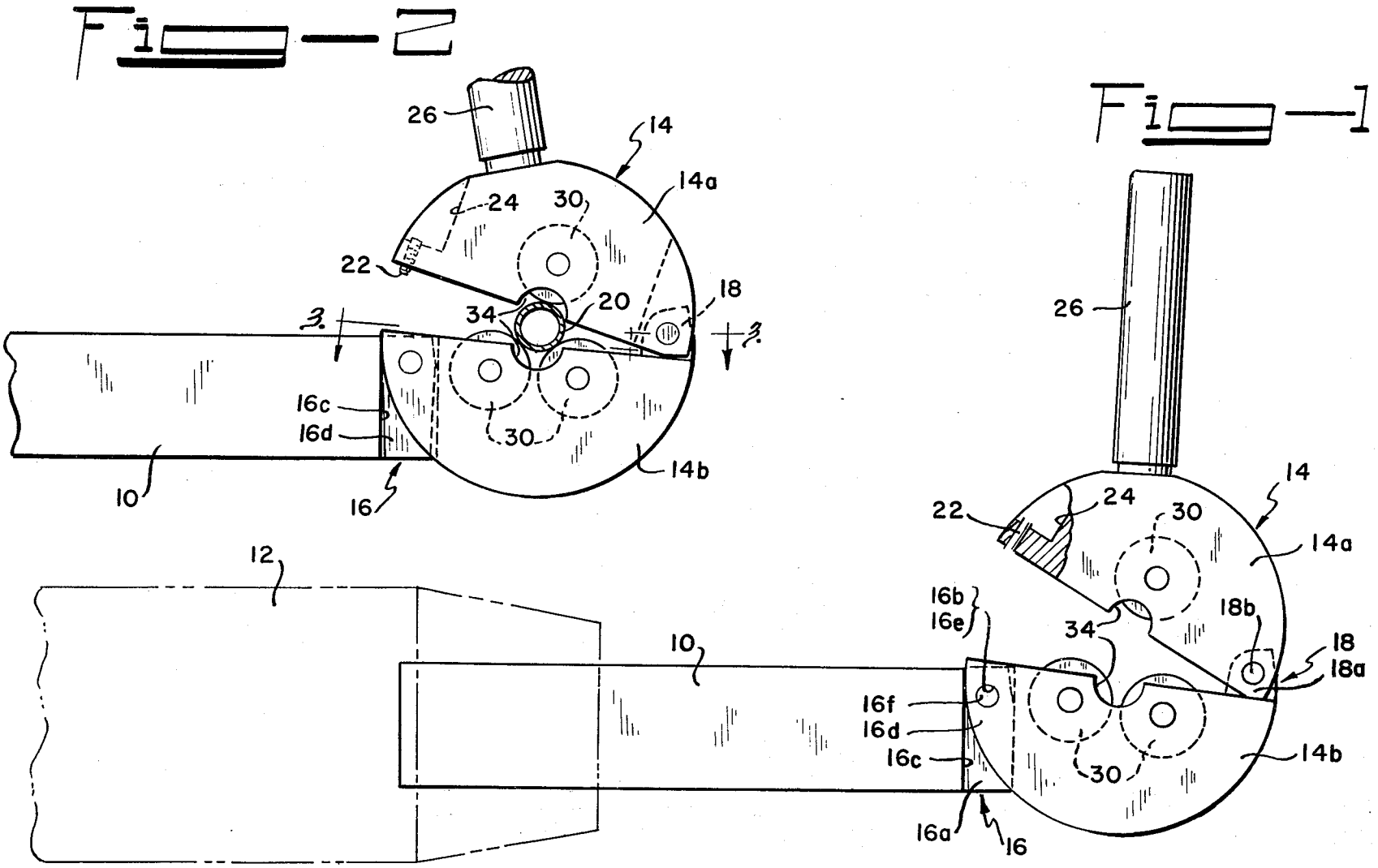
FIG. 1 is an elevation of a forming tool for tubing.
FIG. 2 is an elevation showing a tubular workpiece in position.

Referring to FIG. 1, a tool bar 10 is mounted in a conventional tool holder 12 attached to a lathe which is not shown. A tool head 14, comprising complementary parts 14*a* and 14*b*, is connected by a first hinge 16 to the other end of the tool bar 10. Each tool head part has a facing surface opposing a facing surface on the other tool head part. The hinge 16 to the tool bar 10 is located in tool head part 14*b* near the intersection of the facing surface and the circumference of tool head part 14*b*. The end of the tool bar 10 is reduced in thickness, terminating in two parallel faces forming a hinge leaf 16*a* with a hinge pin hole 16*b* normal to the faces. As shown by FIG. 3, the transition from the wide to the narrow portion of the tool bar 10 is accomplished by a shoulder 16*c* on either side which is a surface perpendicular to the side of the tool bar in the embodiment shown; this provides clearance for the rotation of tool head part 14*b* with respect to tool bar 10. Two complementary leaves 16*d* for the hinge 16 are formed as part of tool head 14*b*. A hole 16*e*, in registry with the hole 16*b* in the hinge leaf 16*a* in the tool bar 10, is located in each of the two hinge leaves 16*d* formed out of tool head part 14*b*. The leaves 16*a* and 16*d* are joined by a hinge pin 16*f*. FIG. 4 displays a face 17*a* on hinge leaf 16*a*, and a complementary face 17*b* on tool head part 14*b;* these function together to limit the rotation of tool head part 14*b*. Face 17*a* has two flat portions, 17*c* and 17*d*. Portion 17*c* limits the movement of tool head part 14*b* when a rib is being formed in a tubular workpiece 20. The center of the tool head 14 is thus prevented from moving past the longitudinal centerline of the workpiece 20; this prevents the finished workpiece 20 from being bowed so that its longitudinal axis is no longer straight. Portion 17*d* stops the movement of tool head part 14*b* when it is moving away from the workpiece 20.

As revealed most clearly by FIGS. 3 and 4, tool head part 14*a* is attached by a second hinge 18 which is similar in construction to the tool bar hinge 16 except that each of the hinge leaves 18*a* formed in part 14*a* is cut away at the intersection of the circumference of part 14*a* and its facing surface. This permits tool head part 14*a* to rotate in a limited arc about the hinge pin 18*b*. The hinges 16 and 18 together permit the required movement of the tool head 14 with respect to the tubular workpiece 20.

Returning to FIG. 2, the tool head 14 is in the closed position about the tubular workpiece 20 which is ready for forming. The workpiece 20 will be supported at either end by lathe centers which are not shown. The spacing between the facing surfaces of tool head parts 14*a* and 14*b* is determined by a screw 22 which has threaded engagement with tool head part 14*a* and projects therefrom into contact with tool bar 10. The screw 22 determines the depth of the rib which will be formed in the tubular workpiece 20; in the present embodiment, the range of rib depths extends to 0.016 inches, as measured from the inner surface of the unribbed workpiece 20 to the deepest projection of the rib as finally formed in the workpiece. The screw 22 is adjusted through a notch 24 in the circumference of tool head part 14*a*.

A handle 26 attached to tool head part 14*a* is used to open and close the tool head 14 and exert pressure on the tubular workpiece 20 to form a rib.

Turning again to FIG. 4, the interior of tool head part 14*b* defines a hollow 28 large enough to accept two rollers 30. Each roller has a thin circumferential flange 30*a* extending from it. In the present embodiment, the flanges 30*a* taper to flat edges which are 0.010 inches thick. The flanges 30*a* lie in a single plane perpendicular to the longitudinal axis of the tubular workpiece 20. The rollers 30 are rotatably mounted on axles 30*b* retained in tool head part 14*b* on radii spaced 120° apart. The rollers 30 are equidistant from the center of the tool head 14.

The interior of tool head part 14*a* defines a similar but smaller hollow 32 large enough to accept a single roller 30 constructed and retained identically to the two rollers 30 in tool head part 14*b* except that the radius on which the roller is located is spaced 120° away from the radii on which each of the part 14*b* rollers 30 are mounted. The roller 30 in tool head part 14*a* travels on a path described by a circle which has its center located at the center of the hinge pin 18*b*. The ratio of the radius of this circle to the depth of the deepest rib to be formed in the tubular workpiece 20 determines the accuracy of the tool. The circumference of the circle is located to intersect the circumference of another circle at a right angle; the second circle represents the outer diameter of the cross section of a ribbed tubular workpiece 20 taken at the deepest point of the rib where the rib depth is half of the maximum rib depth the tool is capable of. Therefore, as the radius of the first circle increases with respect to the maximum rib depth, the arc of the first circle is increasingly close to a straight line tangent to that arc at the intersection of the two circles. The result is that, over the full range of rib depths the rib forming tool is suitable for, the motion of the roller 30 in tool head part 14*a* is very nearly a straight line, at a right angle to a line connecting the centers of the rollers 30 in tool head part 14*b*. Hence, within the limits of the tool, 0.016 inches in the present embodiment, a circle may be inscribed in the space between the three rollers 30 and this circle will touch all three roller flanges 30*a* at 120° intervals, insuring that the tubular workpiece 20, once ribbed, will not lose its circularity.

As shown in FIG. 2, the tubular workpiece 20 is placed in a hole 34 at least as large as the largest workpiece to be ribbed. Hole 34 is composed of two semicircular notches, one in each facing surface of tool head parts 14*a* and 14*b*. Prior to insertion in hole 34, the tubular workpiece 20 is filled with a low melting point plastic tooling compound, manufactured under the trademark "Rigidax", which supports the workpiece 20 and prevents the outer diameter of the workpiece 20 from being reduced as successive ribs are formed. Other tooling compounds may also be used. Each of the three roller flanges 30*a* overlap the hole 34 (see FIG. 1) by a distance at least equal to the depth of the deepest rib to be formed; in the present embodiment, this is 0.016 inches. A purpose of the hinge 16 is to insure that both roller flanges 30*a* in tool head part 14*b* contact the tubular workpiece 20 and exert equal pressure. To accomplish this, the tubular workpiece 20 must be located so its longitudinal axis lies on a circle which bisects a straight line between the centers of the rollers 30 in tool head part 14*b;* the center of the circle is located at the center of the hinge pin 16*f*. If contact were not made thusly, loss of circularity of the workpiece would result since the shape inscribable between the three rollers 30 after completion of the rib would no longer be a circle touching the three roller flanges 30*a* at 120° intervals.

Tool head part 14*a* is then closed on the workpiece 20; all three roller flanges 30*a* make rolling contact with the workpiece 20 and rib formation begins. As the rib is gradually formed, force exerted on the handle 26 keeps the roller flanges 30*a* in contact with the tubular workpiece 20, tool head part 14*a* rotating about the center of hinge pin 18*b* in response to the force exerted on the handle 26 which creates a moment about hinge pin 18*b*. Similarly the roller flanges 30*a* in tool head part 14*b* are kept in contact with the workpiece 20 by a force transmitted through the hinge 18 and creating a moment about the center of hinge 16*f* thus rotating tool head part 14*b*. The rotation of tool head part 14*a* about hinge 18 is stopped when the screw 22 strikes tool bar 10. If the screw 22 were fully retracted, tool head part 14*b* would stop when face 17*b* contacted portion 17*c* of face 17*a* on hinge leaf 16*a;* normally, however, the screw 22 performs this function. Since head part 14*b* is connected to tool head part 14*a* by hinge 18, rotation of tool head part 14*b* about hinge 16 also stops. Since, within the limits of the tool, the roller 30 in tool head part 14*a* is approaching the rollers 30 in tool head part 14*b* by the path previously described, the circularity of the tubular workpiece 20 is maintained within desired limits.

Once formation of the rib is complete, as shown by FIGS. 3 and 4, the tool head 14 must be relocated along the longitudinal axis of the workpiece 20 in order to form the next rib. However, tool head part 14*a* must be rotated away from tool head part 14*b*, and part 14*b* must be rotated away from the workpiece 20, until the roller flanges are removed from the external groove in the tubular workpiece 20 which interferes with movement of the tool head 14 along the longitudinal axis of the workpiece. The tool head 14 can then be relocated and the sequence repeated. The pitch, or spacing between adjacent ribs, is variable and rib depth is also variable within limits of the tool head 14.

The embodiments of the invention in which an exclusive property or priviledge is claimed are defined as follows:

1. A rib forming tool comprising:

a tool holding bar;

a tool head having two complementary tool head parts with a first tool head part hinged to the tool bar, whereby the tool bar permits limited pivotal motion of the first tool head part with respect to said tool bar and the second tool head part is hinged to the first tool head part, whereby the second part may achieve limited pivotal motion with respect to the first part;

two rollers located in the first tool head part and rotatably retained by axles parallel to the longitudinal axis of the tubular workpiece and located equidistantly from the center of the tool head on radii 120° apart, each roller having a thin flange located in a single forming plane normal to the longitudinal axis of the workpiece;

a third roller similarly located in the second tool head part and similarly rotatably retained by an axle on a radius 120° from each of said axle radii in the first part, the third roller having a thin flange disposed in the single forming plane;

an adjustable screw means located in the second tool head part and penetrating through a facing surface of the second part between the center of the tool head and the circumference of the second part nearest the tool bar against the tool bar, whereby the degree of closure between the two complementary tool head parts may be controlled, thus regulating the depth of the rib formed in a tubular workpiece, the tool head having a hole exposing an equal portion of each of the three roller flanges in the single forming plane and of a diameter at least equal to that of the largest workpiece to be formed, whereby the tubular workpiece may be passed through the hole, supported on either end in a lathe while the second tool head part is raised away from the first tool tool head part and the first part is pivoted slightly with respect to the tool bar so that upon rotation of the tubular workpiece by the lathe, the the second tool head part may be brought into contact with workpiece by the handle thus simultaneously raising the first tool head part by means of the hinges and bringing the three roller flanges into contact with the tubular workpiece in the single forming plane, thereby exerting a pressure on the tubular workpiece and forming a circumferential internal rib in the tubular workpiece.

2. A rib forming tool for use in combination with lathe means capable of supporting and rotating a tubular workpiece, said tool comprising:

a tool head having first and second complementary tool head parts, each having a semicircular notch within its facing surface, said facing surfaces being closed around a tubular workpiece by a first hinge connecting the tool head parts;

a second hinge connecting the second tool head part to a support means to permit release of the tool head from the workpiece and pressing of internal circumferential ribs into the workpiece, the support means incorporating a stop to limit rotation of the tool head and the second hinge being located on the periphery of the tool head opposite the first hinge;

three rollers mounted rotatably within the tool head equidistant from the center of the tool head, one of the rollers being mounted in the first tool head part on a radius at a right angle to the facing surface of the tool head part and the other rollers being mounted in the second tool head part on radii spaced 120 degrees from the radius on which the roller in the first tool head part is located, the roller in the first tool head part traveling on a curved line which has as its radius the distance between the centers of the roller in the first tool head part and the first hinge, the curved line approaching a straight line, tangent to the curved line at the point of intersection with a circle representing the deepest point of a rib where the rib depth is one half of the maximum rib depth, as the radius of the curved line is increased relative to the maximum rib depth, whereby the circularity of the tubular workpiece is maintained as ribs are formed;

means for pressing the rollers into the tubular workpiece to form the circumferential ribs therein, which means is attached to the first tool head part thereby allowing the first tool head part to move in an arc about the first hinge and the second tool head part to move in an arc about the second hinge.

* * * * *